US009692145B2

(12) United States Patent
Seehoffer et al.

(10) Patent No.: US 9,692,145 B2
(45) Date of Patent: Jun. 27, 2017

(54) MECHANICAL LUG WITH DOVETAIL INTERLOCK FEATURE

(71) Applicant: Panduit Corp., Tinley Park, IL (US)

(72) Inventors: Francis Seehoffer, New Lenox, IL (US); Robert L. Sokol, Orland Park, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 15/042,341

(22) Filed: Feb. 12, 2016

(65) Prior Publication Data

US 2016/0164194 A1 Jun. 9, 2016

Related U.S. Application Data

(63) Continuation of application No. 14/323,038, filed on Jul. 3, 2014, now Pat. No. 9,293,841.

(60) Provisional application No. 61/844,501, filed on Jul. 10, 2013.

(51) Int. Cl.

| | |
|---|---|
| ***H01R 4/36*** | (2006.01) |
| ***H01R 4/30*** | (2006.01) |
| ***H01R 11/12*** | (2006.01) |

(52) U.S. Cl.

CPC ..... *H01R 4/30* (2013.01); *H01R 4/36* (2013.01); *H01R 11/12* (2013.01)

(58) Field of Classification Search

CPC ..... H01R 4/30; H01R 4/36; H01R 11/12
USPC ..... 439/815, 724, 712, 814, 810, 883, 884
See application file for complete search history.

(56) References Cited

U.S. PATENT DOCUMENTS

| | | | |
|---|---|---|---|
| 2,161,249 | A | 6/1939 | Dibner |
| 2,885,654 | A | 5/1959 | Norden |
| 2,907,978 | A | 10/1959 | Bergan |
| 3,638,172 | A | 1/1972 | Adam |
| 3,638,173 | A | 1/1972 | Middendorf et al. |
| 3,775,733 | A | 11/1973 | Ege |
| 4,545,640 | A | 10/1985 | Buchberger |
| 4,603,376 | A | 7/1986 | Maier |
| 5,269,710 | A | 12/1993 | Donnerstag |
| 5,674,079 | A | 10/1997 | Auclair |
| 5,771,983 | A | 6/1998 | Rottmann |
| 5,978,208 | A | 11/1999 | Helms et al. |
| 6,074,121 | A | 6/2000 | Medeiros et al. |
| 6,211,759 | B1 | 4/2001 | Little et al. |
| D487,062 | S | 2/2004 | Foster |
| 7,056,163 | B2 | 6/2006 | Hay |

(Continued)

FOREIGN PATENT DOCUMENTS

| | | |
|---|---|---|
| CN | 101471204 A | 7/2009 |
| CN | 201490349 U | 5/2010 |

(Continued)

*Primary Examiner* — Javaid Nasri
(74) *Attorney, Agent, or Firm* — Christopher S. Clancy; James H. Williams; Aimee E. McVady

(57) ABSTRACT

The present invention is directed to a mechanical lug with interlocking features that secures an electrical conductor. The mechanical lug has a main body and a mounting tongue extending from the main body. The main body includes an inner flange and an outer flange. The inner flange has a horizontal member and an interlocking member with angled pockets. The outer flange has hooks with a tapered face positioned in the angled pockets of the interlocking member of the inner flange thereby forming a dovetail interlock.

7 Claims, 5 Drawing Sheets

(56) References Cited

U.S. PATENT DOCUMENTS

| | | | | |
|---|---|---|---|---|
| 7,137,833 | B2 | 11/2006 | Woodward | |
| 7,632,160 | B2 | 12/2009 | Corry et al. | |
| 7,766,704 | B2 | 8/2010 | Robinson et al. | |
| 7,909,633 | B1 | 3/2011 | Miller et al. | |
| 8,011,978 | B2 | 9/2011 | Cortes Rico et al. | |
| 9,293,841 | B2 * | 3/2016 | Seehoffer ..... | H01R 4/30<br>439/814 |
| 2006/0292922 | A1 | 12/2006 | Froschl | |

FOREIGN PATENT DOCUMENTS

| | | | |
|---|---|---|---|
| DE | 102009049709 | A1 | 4/2011 |
| EP | 2075811 | A2 | 7/2009 |

* cited by examiner

MECHANICAL LUG WITH DOVETAIL INTERLOCK FEATURE

CROSS-REFERENCE TO RELATED APPLICATIONS

This application is a continuation of U.S. patent application Ser. No. 14/323,038, filed Jul. 3, 2014, and claims priority to U.S. Provisional Application Ser. No. 61/844,501, filed Jul. 10, 2013, the subject matter of which is hereby incorporated by reference in its entirety.

FIELD OF THE INVENTION

The present invention relates to a mechanical lug, and more particularly to a mechanical lug with an interlock feature.

BACKGROUND OF THE INVENTION

Mechanical lug connectors are used to secure electrical conductors. FIGS. 1, 2, and 3A-C illustrate prior art mechanical lug connectors. The mechanical lug 10 illustrated in FIG. 1 includes a main body 12 with overlapping flanges 14, 16 and a mounting tongue 18. The mechanical lug 10 does not include any interlocking features. As such, the flanges 14, 16 tend to open up and separate from each other when tightening the screw 20 that secures the electrical conductor positioned therein.

The mechanical lug 30 illustrated in FIGS. 2 and 3A-C is an improvement over the mechanical lug 10 illustrated in FIG. 1. The mechanical lug 30 includes a main body 32 with a mounting tongue 42. The main body 32 has an inner flange 34 with a T-shaped cut out 36 and an overlapping outer flange 37 with a T-shaped flange 38. As illustrated in FIG. 3B, the T-shaped flange 38 of the outer flange 37 is positioned within the T-shaped cut out 36 of the inner flange 34. The side walls 40 of the inner flange 34 are weakened due to the T-shaped cut out 36. As a result, when the screw 44 is tightened to secure an electrical conductor, the T-shaped flange 38 pulls upward thereby opening up the lug and separating the flanges from each other.

Thus, the flanges of prior art lugs, such as those discussed above, tend to open up and separate from each other as the screw securing the electrical conductor is being tightened to the specified torque.

Therefore, there is a need for an improved mechanical lug connector with interlocking features that do not separate when a screw is tightened to secure an electrical conductor positioned therein.

SUMMARY OF THE INVENTION

The present invention is directed to a mechanical lug that is used to secure electrical conductors. The mechanical lug has a main body with a mounting tongue extending from the main body. The main body has an inner flange and an overlapping outer flange. The inner flange includes a horizontal member and an interlocking member with angled pockets. The outer flange includes hooks with a tapered face. The hooks of the outer flange are positioned in the angled pockets of the interlocking member of the inner flange to secure the mechanical lug.

DETAILED DESCRIPTION

Figure 2:
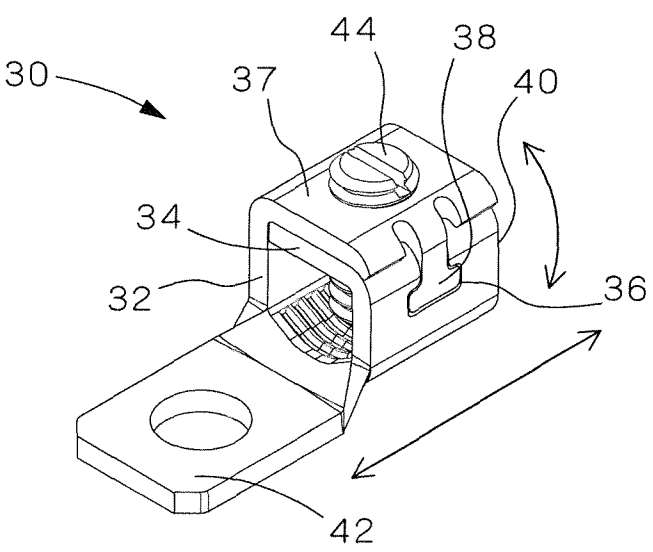
FIG.2 Prior Art
FIG. 2 is a perspective view of a prior art mechanical lug.
Figure 1:
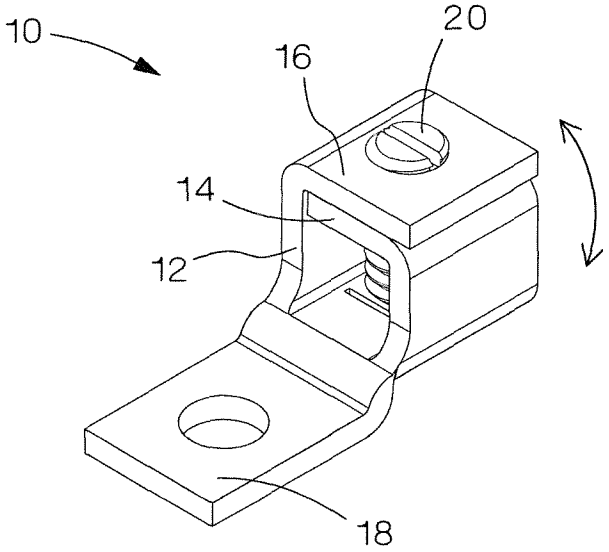
FIG.1 Prior Art
FIG. 1 is a perspective view of a prior art mechanical lug.
Figure 3A:
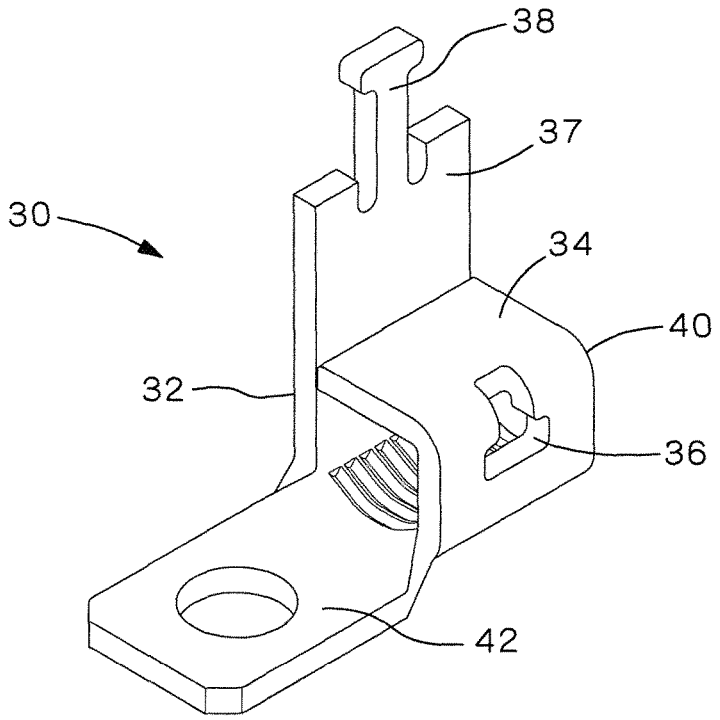
FIG.3A Prior Art
FIG. 3A is a perspective view of the prior art mechanical lug of FIG. 2 with the outer flange extended prior to overlapping the inner flange.
Figure 3B:
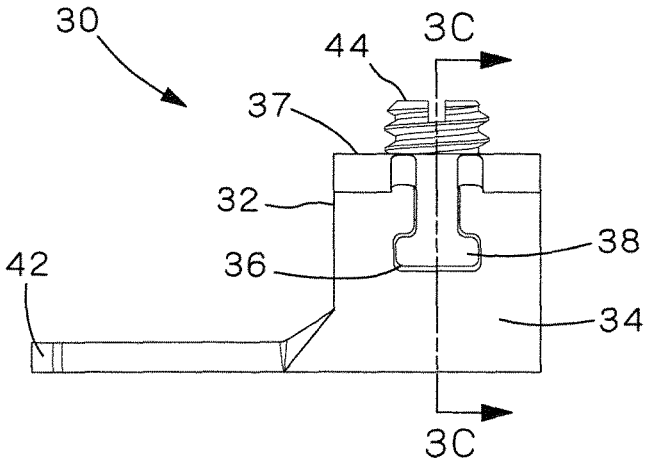
FIG.3B Prior Art
FIG. 3B is a side view of the prior art mechanical lug of FIG. 2.
Figure 3C:
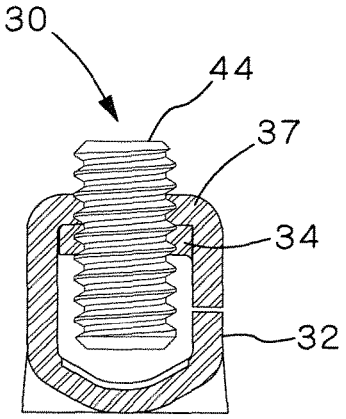
FIG.3C Prior Art
FIG. 3C is a cross sectional view of the prior art mechanical lug taken along line 3C-3C of FIG. 3B.
Figure 4:
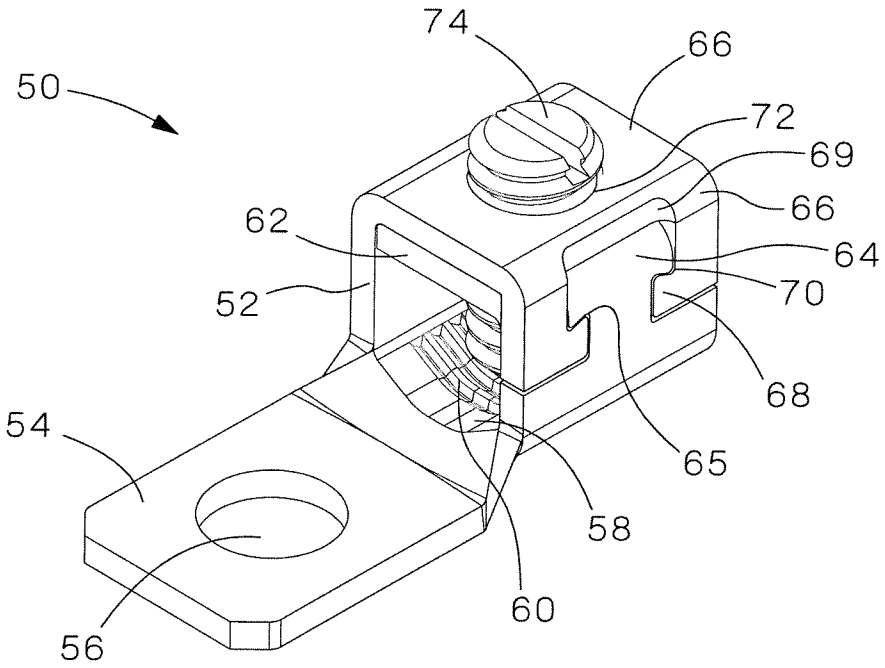
FIG. 4 is a perspective view of the mechanical lug of the present invention.
Figure 5A:
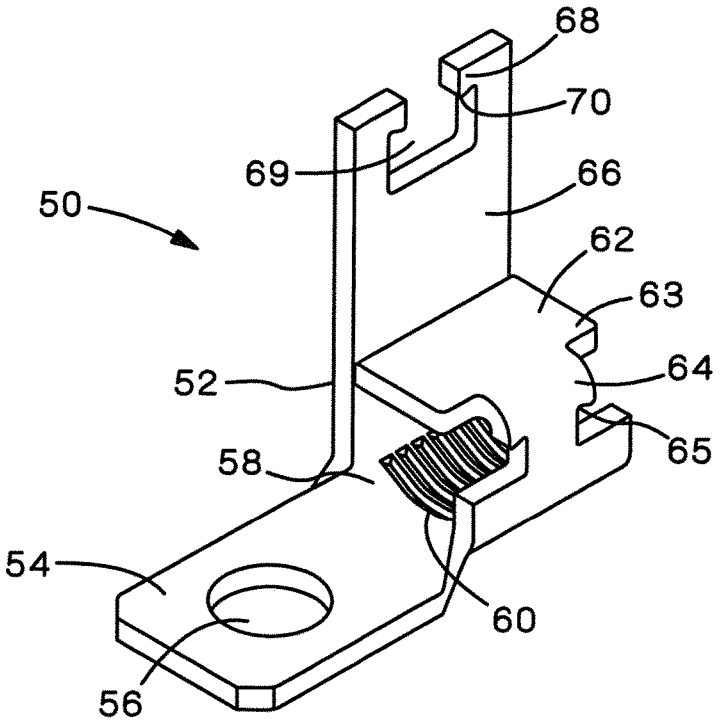
FIG. 5A is a perspective view of the mechanical lug of FIG. 4 with the outer flange extended prior to overlapping the inner flange.
Figure 5B:
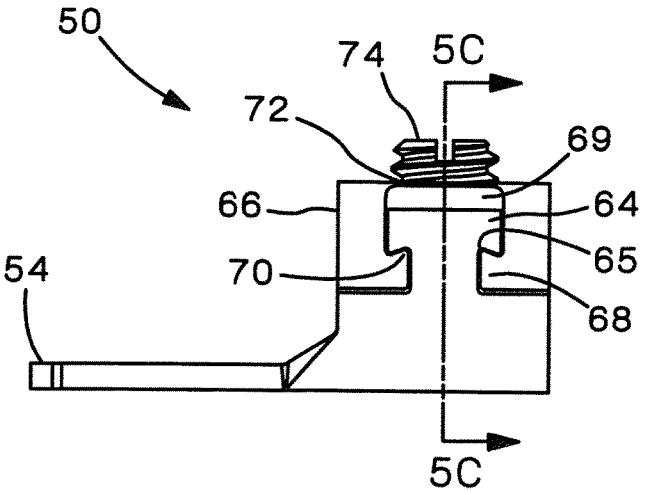
FIG. 5B is a side view of the mechanical lug of FIG. 4.
Figure 5C:
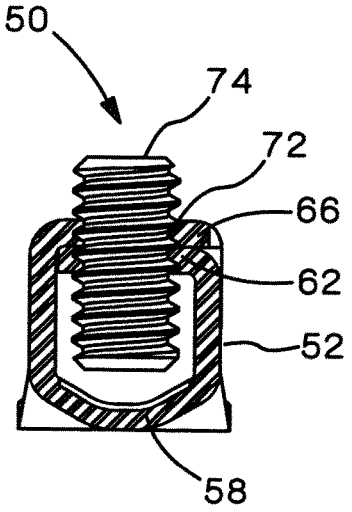
FIG. 5C is a cross sectional view of the mechanical lug taken along line 5C-5C of FIG. 5B.
Figure 6:
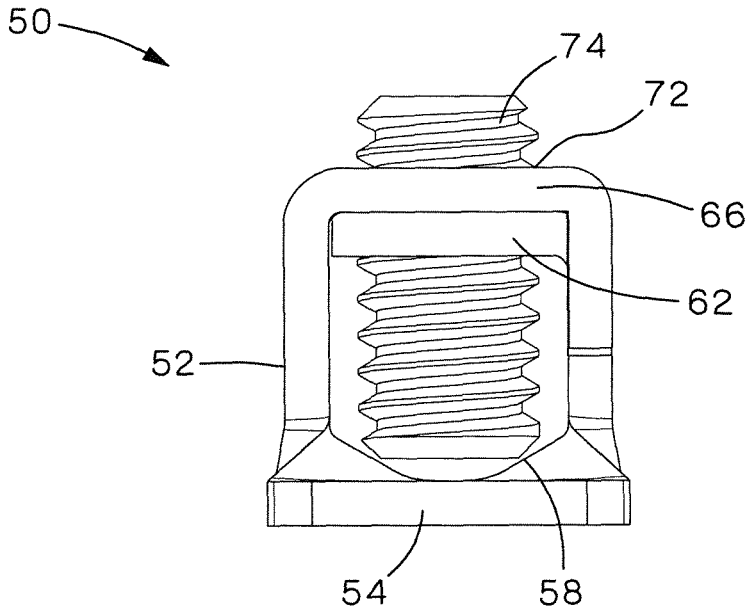
FIG. 6 is a front view of the mechanical lug of FIG. 4.

FIGS. 4-6 illustrate the mechanical lug 50 of the present invention. The mechanical lug 50 is an integral piece that includes a main body 52 and a mounting tongue 54. The mounting tongue 54 extends from the main body 52 and includes a hole 56 for receiving a fastener to secure the mechanical lug 50 to a bus bar or other device.

The main body 52 is formed from sheet metal into a generally box shape designed to accommodate various sizes of electrical conductors. The main body 52 includes a bottom 58, an inner flange 62 and an outer overlapping flange 66. The bottom 58 is generally V-shaped with serrations 60 for receiving the electrical conductor. The serrations 60 increase the wire retention when the conductor is installed thereby improving the strength of the mechanical lug 50.

As illustrated in FIG. 5A, the inner flange 62 includes a horizontal member 63 and an interlocking member 64. The interlocking member 64 includes open sides that define angled pockets 65. The outer overlapping flange 66 has two hooks 68 with tapered faces 70 and an opening 69. As illustrated in FIG. 5B, the opening 69 of the outer flange 66 receives the interlocking member 64 of the inner flange 62. The hooks 68 with tapered faces 70 are positioned within the angled pockets 65 formed in the interlocking member 64 of the inner flange 62. The pockets 65 of the interlocking member 64 and the tapered faces 70 of the hooks 68 provide a strong dovetailed interlock.

A tapped hole 72 at the top of the main body 52 extends through both the outer overlapping flange 66 and the inner flange 62. The tapped hole 72 accommodates a set or cap screw 74 for securing electrical conductors in the main body 52.

The dovetailed interlock formed by the inner flange 62 and the outer overlapping flange 66 prevents the main body 52 from separating when the screw 74 is tightened to secure the electrical conductor positioned therein. The interlocking flanges of the mechanical lug of the present invention increase the integrity and the strength of the mechanical lug when compared to prior art lugs. Additionally, the mechanical lug of the present invention is cost effective and easy to manufacture.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

The invention claimed is:

1. A mechanical lug for securing electrical conductors, the mechanical lug comprising:

a main body having an inner flange and an outer flange;

wherein the inner flange having a horizontal member and an interlocking member, each side of the interlocking member being an open side defining angled pockets; and wherein the outer flange having hooks with a tapered face, the hooks of the outer flange are positioned in the open sides of the inner flange and the hooks of the outer flange engage the angled pockets of the interlocking member of the inner flange.

2. The mechanical lug of claim 1, wherein the outer flange over laps the inner flange.

3. The mechanical lug of claim 1, wherein the hooks of the outer flange are L-shaped.

4. The mechanical lug of claim 1, wherein the hooks of the outer flange define an opening, the opening receives the interlocking member of the inner flange.

5. The mechanical lug of claim 1, wherein the inner flange and outer flange mate to form a dovetail interlock.

6. A mechanical lug for securing electrical conductors, the mechanical lug comprising:

a main body having an outer flange and an inner flange, wherein the inner flange having a horizontal member and an interlocking member with open sides that form angled pockets; and wherein the outer flange having hooks with a tapered face, the tapered face of the hooks engage the angled pockets of the interlocking member of the inner flange to form a dovetail interlock.

7. The mechanical lug of claim 6, wherein the interlocking member is T-shaped.

* * * * *